US008979667B1

(12) United States Patent
Tipton

(10) Patent No.: US 8,979,667 B1
(45) Date of Patent: Mar. 17, 2015

(54) GOLF PUTTER HEAD

(71) Applicant: The University of Tulsa, Tulsa, OK (US)

(72) Inventor: Steven M. Tipton, Tulsa, OK (US)

(73) Assignee: The University of Tulsa, Tulsa, OK (US)

( * ) Notice: Subject to any disclaimer, the term of this patent is extended or adjusted under 35 U.S.C. 154(b) by 34 days.

(21) Appl. No.: 13/907,222

(22) Filed: May 31, 2013

(51) Int. Cl.
*A63B 53/04* (2006.01)
*A63B 53/06* (2006.01)

(52) U.S. Cl.
CPC ..... *A63B 53/0487* (2013.01); *A63B 53/065* (2013.01)
USPC ..... 473/324; 473/329; 473/330; 473/331; 473/332; 473/340; 473/342; 473/349; 473/409

(58) Field of Classification Search
USPC ..... 473/324, 329, 330, 331, 332, 342, 340, 473/341, 313, 349, 409
See application file for complete search history.

(56) References Cited

U.S. PATENT DOCUMENTS

| | | | | |
|---|---|---|---|---|
| 1,250,296 | A | 12/1917 | Fitzjohn | |
| 3,019,022 | A | 1/1962 | Ehmke | |
| 3,064,975 | A | 11/1962 | Smith | |
| 3,770,279 | A | 11/1973 | Phinny | |
| D235,668 | S | 7/1975 | Swash | |
| 4,240,636 | A | 12/1980 | Swenson | |
| 4,836,550 | A | 6/1989 | Kobayashi | |
| 4,953,866 | A | 9/1990 | Bang | |
| 4,984,799 | A | 1/1991 | Finney | |
| 5,441,272 | A | 8/1995 | Ugarte | |
| 5,531,439 | A | 7/1996 | Azzarella | |
| 5,542,675 | A * | 8/1996 | Micciche et al. | 473/329 |
| 5,618,239 | A | 4/1997 | Rife | |
| 5,620,381 | A | 4/1997 | Spalding | |
| 5,676,606 | A | 10/1997 | Schaeffer et al. | |
| 5,690,561 | A * | 11/1997 | Rowland et al. | 473/330 |
| 5,692,968 | A | 12/1997 | Shine | |
| 5,709,616 | A | 1/1998 | Rife | |
| 5,782,705 | A | 7/1998 | Solari | |
| D399,911 | S | 10/1998 | Nicolette et al. | |
| 5,816,930 | A | 10/1998 | Brown | |
| 5,846,140 | A | 12/1998 | Hoburg | |
| 6,203,445 | B1 | 3/2001 | Rhodes et al. | |
| 6,224,496 | B1 * | 5/2001 | Rowland et al. | 473/288 |
| 6,849,004 | B2 * | 2/2005 | Lindsay | 473/330 |
| 7,278,926 | B2 | 10/2007 | Frame | |
| 7,364,513 | B2 | 4/2008 | Krumme | |
| 7,465,240 | B2 * | 12/2008 | Frame | 473/329 |
| 7,862,449 | B2 | 1/2011 | Stites et al. | |
| 7,985,146 | B2 | 7/2011 | Lin et al. | |
| 8,066,587 | B2 | 11/2011 | Tateno et al. | |
| 8,753,223 | B2 * | 6/2014 | Stites | 473/324 |
| 2005/0009623 | A1 | 1/2005 | Dickinson | |
| 2009/0170628 | A1 | 7/2009 | Yoon | |
| 2009/0291773 | A1 | 11/2009 | De La Cruz et al. | |
| 2010/0087269 | A1 | 4/2010 | Snyder et al. | |
| 2011/0039633 | A1 | 2/2011 | Snyder et al. | |

* cited by examiner

*Primary Examiner* — Sebastiano Passaniti
(74) *Attorney, Agent, or Firm* — Head, Johnson & Kachigian, P.C.

(57) ABSTRACT

A golf putter head which includes a putting face having a positive loft angle diverging from vertical to a putter head base. The putting face is formed from a plurality of substantially parallel blades, each of the blades contiguous with each other wherein the blades are arrayed at a downward angle. Each of the blades narrows in width towards the putting face and terminates in a narrow tip. Each of the blades is flexible at its tip in order impart an upward spring force upon impact with a golf ball.

14 Claims, 3 Drawing Sheets

GOLF PUTTER HEAD

BACKGROUND OF THE INVENTION

1. Field of the Invention

The present invention relates to a golf club putter head. In particular, the present invention relates to a golf putter head that will impart both desired linear and angular momentum components in order to move a golf ball along its intended and desired path.

2. Prior Art

Various traditional, conventional putters have a head with a few degrees of loft (or slight angle). FIG. 1 illustrates a diagrammatic view of a traditional prior art putter 10 with a positive loft angle, $\propto$, and with a center of mass (or gravity) as illustrated by dashed line 12 below the center of mass of the ball. Upon impact of the golf putter head with the ball, these factors cause the ball to lift slightly (as shown by arrow 14 at an angle, $\beta$, with the horizontal axis) and backspin slightly upon initial impact at an angular velocity of w. This encourages the ball to lift and then bounce and skid before rotating in the opposite, normal direction as shown by the ball in a series of positions in FIG. 2. The ball will sequentially rotate counter clockwise, lift from the ground, land back on the ground, bounce, skid and then roll clockwise.

Various putter designs have been proposed in the past. Spalding (U.S. Pat. No. 5,620,381) discloses a golf putter which imparts top spin to a ball. A removable putting face insert has angled leg portions extending at an angle upward and outward. The Spalding putter discloses striking the ball above the center line with a negative loft angle which differs from the proposed invention as will be described in detail herein.

Frame (U.S. Pat. No. 7,278,926) discloses a putter head including an insert to promote transfer of top spin in order to improve control. The insert may be removably mounted. The Frame putter head utilizes a plurality of beams and does not disclose or teach blades. As will be described herein, the present invention employs a plurality of blades on the putter face terminating in narrow tips.

Rife (U.S. Pat. No. 5,618,239) discloses a golf putter head with a grooved face configuration.

There remains a need for a golf putter face to impart desired linear and angular momentum components to improve the efficiency and accuracy of a golf putt.

It is, therefore, a principal object and purpose of the present invention to provide a golf club putter head to enable a golfer to impart both linear and angular momentum components that will roll a golf ball along its intended path.

It is a further object and purpose of the present invention to provide a golf club putter head to allow a golfer to use skill to roll a ball to the hole while decreasing random irregularities on the angular rolling momentum of the ball caused by the ground beneath the grass.

SUMMARY OF THE INVENTION

The present invention is directed to a golf putter head having a putting face with a positive loft angle which diverges from vertical to the putter head base.

A putting face is formed from a plurality of substantially parallel blades. The blades are arranged in a contiguous fashion in a preferred embodiment. The plurality of the blades are bonded in a cartridge and received in a recess in the golf putter body.

Each of the blades is arrayed at a downward angle with respect to the base of the body rather than parallel to the base of the body.

Each of the blades extends towards the putting face and narrows in width as it extends towards the putting face terminating in a narrow point or tip. Each of the blades is flexible at its narrow tip so that when the golf putter head is brought into contact with the ball, the blades are caused to flex. Accordingly, the tips of the blades impart an upward spring force upon impact with the golf ball. The spring force may be customized as a function of material elasticity and blade geometry.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
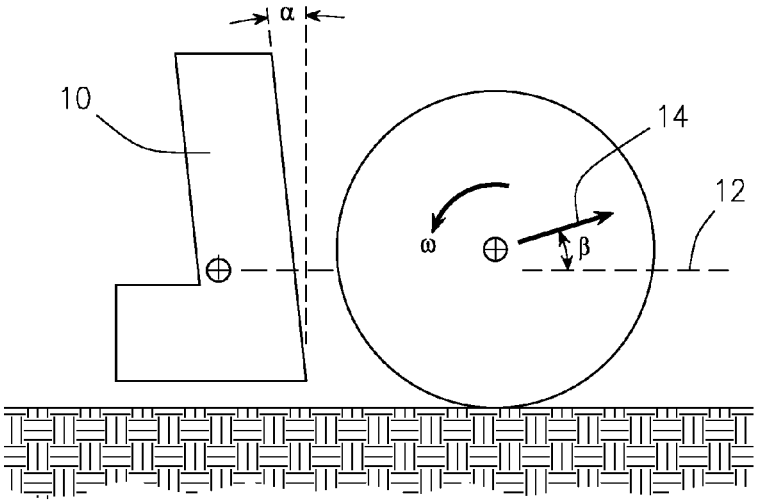
FIG. 1 PRIOR ART
FIG. 1 illustrates a diagrammatic view of a prior art putter.
Figure 2:
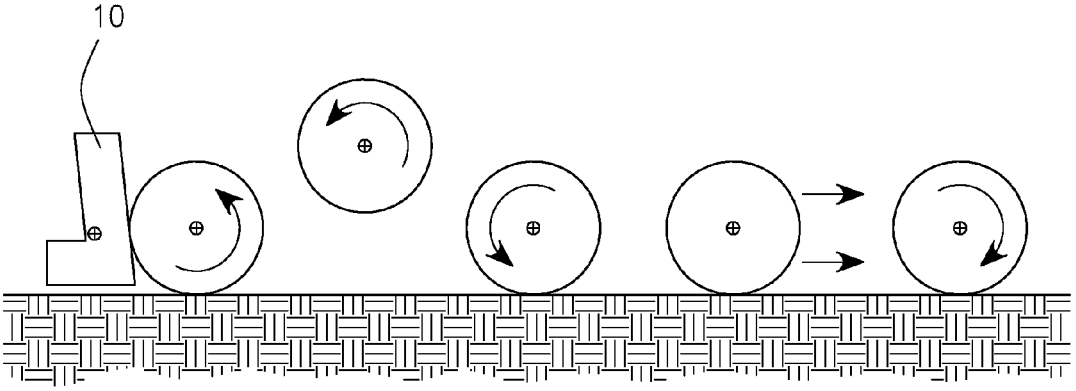
FIG. 2 PRIOR ART
FIG. 2 illustrates a diagrammatic view of the prior art putter shown in FIG. 1 with a sequential view of a golf ball during its movement.
Figure 3:
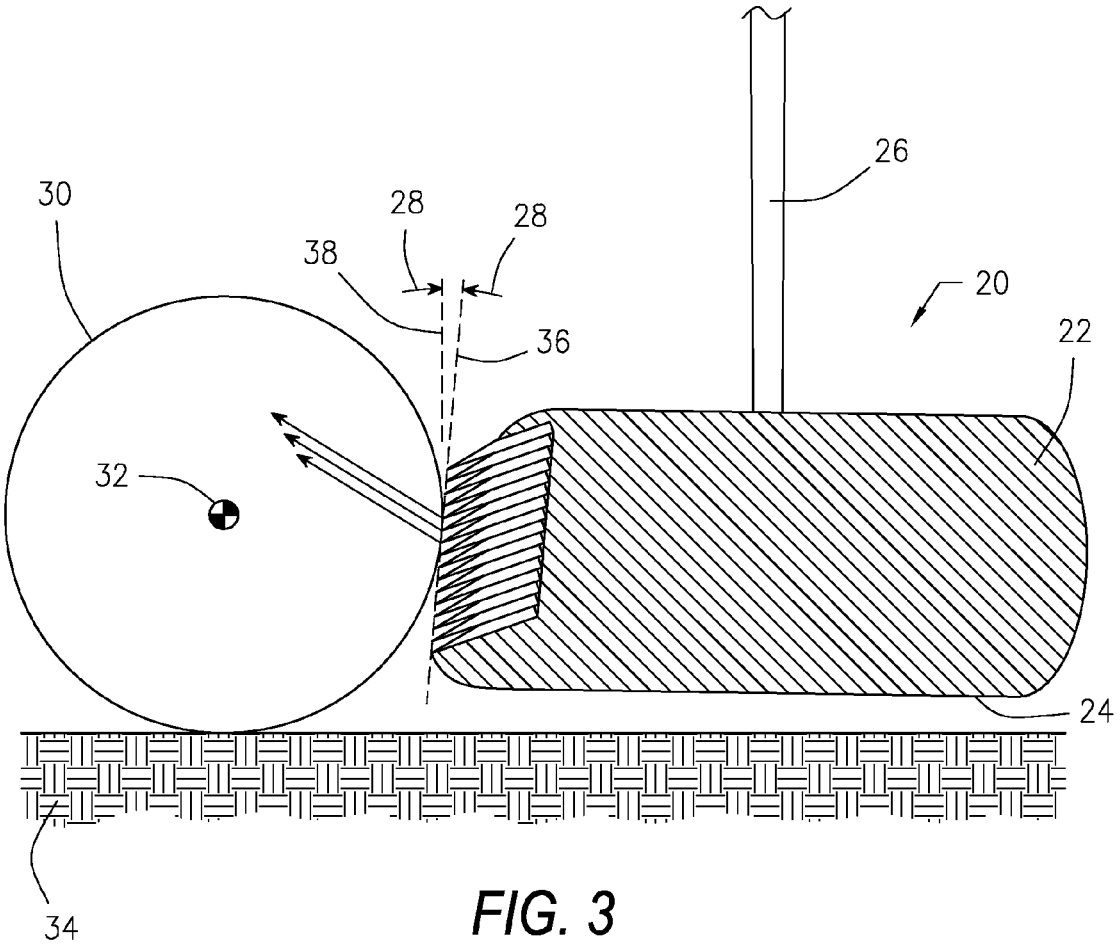
FIG. 3 illustrates a diagrammatic view of a golf putter head constructed in accordance with the present invention.

Referring to the drawings in detail, FIG. 3 illustrates a preferred embodiment of a golf putter head 20 constructed in accordance with a preferred embodiment of the present invention.

A golf ball 30 having a center of mass 32 is shown resting on the ground, such as on a golf course putting green 34.

The golf putter head 20 is shown in cross section for ease of comprehension and includes a body 22 having a putter head base 24. Extending from the golf putter body 22 is a shaft 26 which terminates in a grip (not shown).

The golf putter head 20 also includes a putting face, the front of which is illustrated by dashed line 36. The putting face 36 has a positive loft angle which diverges from vertical (illustrated by dashed line 38) to the putter head base 24. The loft angle may range from 2° to 5°, with a preferred range of 3° to 4°. The arrows 28 illustrates a conventional loft angle of 3° to 4°.

The putting face 36 is formed from a plurality of substantially parallel blades 40. The blades are arranged in a contiguous fashion in a preferred embodiment although they may be spaced from each other. The blades are most likely made from an engineering metal alloy, which could include without limitation steel, carbide, nickel, cobalt, tungsten, or a combination of these and/or other alloys. In the present embodiment, a recess is provided into the golf putter body 22 to receive the plurality of blades 40. The blades may be bonded together to form a cartridge and bonded or otherwise secured to the golf putter body 22. The blades are arrayed at a downward angle with respect to the base of the body 22 rather than parallel to the base of the body 22.

In the event that the blade tips are susceptible to damage, the blades may be retained in a replaceable cartridge so that replacement of the cartridge and accompanying blades is possible.

Figure 4:
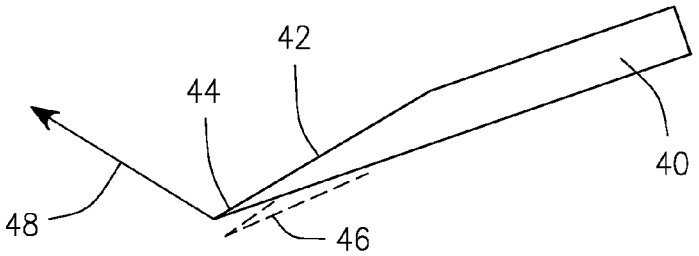
FIG. 4 illustrates one of the blades of the golf putter head as seen in FIG. 3 apart from the putter head.

One of the blades 40 is shown in FIG. 4 apart from the golf putter head 20 for clarity and ease of comprehension. Each of the blades 40 extends toward the putting face 36 and narrows in width as it extends toward the putting face that is shown at 42. Each of the blades 40 terminates in a narrow tip 44. Each of the blades 40 is flexible at its tip 44. As the golf putter head 20 is brought into contact with the ball 30, the blades 40 are caused to flex as shown by dashed line 46. The tips 44 of the blades 40 impart a spring force, shown by arrow 48, upon impact with the golf ball. Accordingly, the spring force may be customized as a function of the blade material and geometry.

A golfer will use the present golf putter on a golf course green. When a golf ball lies on a green, the golfer visualizes a path and a speed that will take the ball directly to the hole. The golfer then uses his/her skill to putt the ball and cause it to roll along that path with the intended speed.

There are two dynamic factors that work together to keep a golf ball rolling along an intended path: linear momentum and angular momentum. The center of mass of the ball moves along its line, but the ball also spins around an axis perpendicular to its line as it rolls. The linear movement causes linear momentum and the rotation causes angular momentum. The angular momentum associated with rolling helps to keep the ball moving along its line, much like a rolling bicycle wheel keeps its rider stable and upright.

But when the ball is sitting on a green it tends to settle into the blades of grass. Therefore, many putters have a positive loft angle that is required to lift the ball gently out of the grass and thus send it along its path.

Unfortunately, the positive loft angle of a conventional putter face causes it to contact the ball below its center of mass, causing the ball to rotate backwards (backspin) as it goes airborne along its intended path. It only gains angular momentum for rolling through skidding and bouncing contact with the irregular surface of the green. Thus, the golfer can only use his/her skill to give the ball its linear momentum. He/she is at the mercy of the terrain of the putting surface for the ball's angular momentum. Furthermore, skidding and bouncing also creates inconsistencies in the speed of a putt due to factors affecting friction, such as moisture content and cut of the grass.

Figure 5:
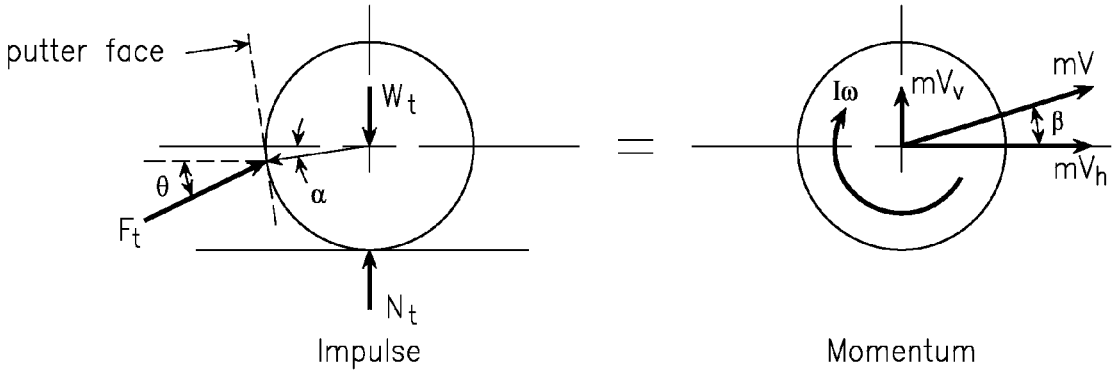
FIG. 5 illustrates a chart showing impulses on a golf ball at rest with the chart to the right showing impulse momentum after impact.

The present invention takes advantage of the dynamic principles of "impulse and momentum" to enable the golfer to use his/her skill to impart both the linear and angular momentum components that will move the ball in a smoothly rolling fashion along its intended path. The putter of the present invention has a conventional loft angle of ∝ (on the order of)3-4° to lift a ball gently from the green, and start it moving along its path. But the impulse vector from the contact with the putter's unique face is designed to occur at a greater angle, θ, thus imparting airborne forward rotation (overspin) to match that of a rolling ball. For a ball of radius R to move in this manner with a horizontal velocity component of Vh, its angular velocity is ω=Vh/R. This is illustrated with the principle of impulse and momentum in the FIG. 5. The left chart in FIG. 5 shows the impulses on a ball at rest while the right chart in FIG. 5 shows the momentum after impact.

When a golf ball at rest on the green is impacted by the putter of the present invention, an impulse vector, $F_T$, is generated at an angle θ as shown in a direction above the ball's center of mass. The impact force, F, occurs below the centroid of the ball due to the loft angle, α, of the putter face, but the force occurs over a period of time, Δt. When the force versus time is integrated, an impulse is computed, Ft, parallel to F. During this time period, two other forces act on the ball: its weight, W and the contact force with the ground, N. These can also be integrated over time to compute the contribution of their impulses, $W_t$ and $N_t$.

Figure 6:
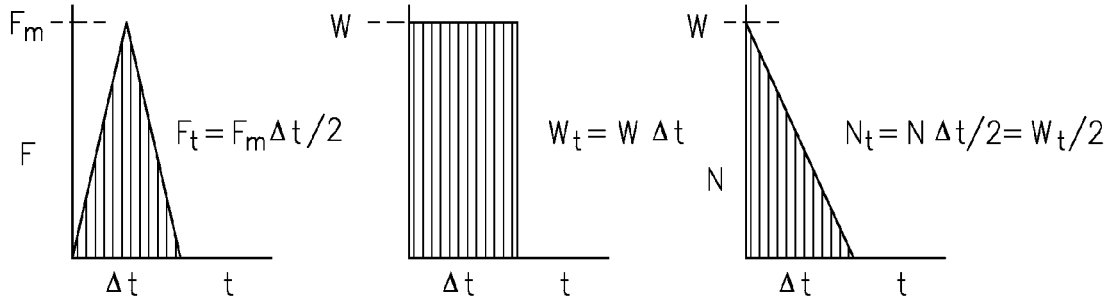
FIG. 6 illustrates a chart showing force versus time illustrating how the impulses can be estimated by assuming linear behavior over duration of the impulse.

FIG. 6 illustrates how the impulses can be estimated by assuming linear behavior over the duration of the impulse.

The result of the impulse is the ball moving with a velocity of V, and an angular velocity, ω. Multiplying these quantities by the mass, m, and moment of inertia, I, of the ball, respectively, produces the linear momentum, mV, and the angular momentum, Iω, as shown in FIG. 5. The linear momentum can be decomposed into its horizontal and vertical components, mVh and mVv, as shown (where Vh=V cos β and Vv=V sin β). A ball purely rolling would have an angular velocity equal to Vh/R, where R is the radius of the golf ball. The moment of inertia for a sphere of mass m is given by:

$$I = \frac{2}{5}mR^2$$

Using these definitions, the linear and angular impact/momentum equations illustrated in FIG. 5 are given by:

$$F_t \cos\theta = mV\cos\beta$$

$$F_t \sin\theta + N_t - W_t = mV\sin\beta$$

$$F_t R(\sin\theta\cos\alpha - \cos\theta\sin\alpha) = I\omega = I\frac{V\cos\beta}{R}$$

These equations, with the definitions of the impulses in FIG. 6, can be used to compute the equation for θ, the direction of the impulse force that causes over spin at a rate that corresponds to pure rolling:

$$\theta = \tan^{-1}\left[\frac{0.4 + \sin\alpha}{\cos\alpha}\right]$$

For example, a 3° loft angle gives θ=24.4° and a 4° loft angle gives θ=25.2°. This gives the geometry information needed to design the orientation and stiffness characteristics of the blades on the face of the putter (approximately 70°-90° to the angle θ). Accordingly, the present invention provides a customizable coefficient of restitution.

With this putter face geometry, the golfer now provides all of the kinetic energy components to the ball, both the linear and angular that are responsible for keeping the ball on its intended line. The golfer can now use his or her skill to roll the ball to the hole and no longer must rely on the random irregularities of the ground beneath the neatly mowed grass to provide the angular rolling momentum to the ball.

Whereas, the present invention has been described in relation to the drawings attached hereto, it should be understood that other and further modifications, apart from those shown or suggested herein, may be made within the spirit and scope of this invention.

What is claimed is:

1. A golf putter head which comprises:

a putting face having a positive loft angle diverging from vertical to a putter head base;

said putting face formed from a plurality of substantially parallel blades, each of said blades contiguous with each other wherein said blades are arrayed at a downward angle;

each of said blades narrowing in width towards said putting face and terminating in a narrow tip; and each of said blades flexibly resilient at its tip.

2. A golf putter head as set forth in claim 1 wherein said putting face loft angle is between 2 and 5 degrees.

3. A golf putter head as set forth in claim 2 wherein said putting face loft angle is between 3 and 4 degrees.

4. A golf putter head as set forth in claim 1 wherein said plurality of blades are adhesively bonded to said putter head base.

5. A golf putter head as set forth in claim 1 wherein said plurality of blades is received in a recess in said putter head base.

6. A golf putter head as set forth in claim 1 wherein said plurality of blades is retained in a replaceable cartridge.

7. A golf putter head as set forth in claim 1 wherein said putting face has a customizable coefficient of restitution.

8. A golf putter head as set forth in claim 7 wherein said plurality of blades is retained in a replaceable cartridge.

9. A golf putter head which comprises:

a putting face having a positive loft angle diverging from vertical to a putter head base;

said putting face formed from a plurality of substantially parallel blades, each of said blades contiguous with each other wherein said blades are arrayed at a downward angle;

each of said blades narrowing in width towards said putting face and terminating in a narrow tip; and wherein each of said blades is flexibly resilient at its tip such that the resilient tips of said parallel blades impart a spring force upon impact with a golf ball, said blades are oriented such that said spring force is an impulse force at angle θ, such that the impulse force creates over spin at a rate corresponding to pure rolling, and wherein such an arrangement of the parallel blades is determined through implementation of equation $$\Theta = \tan^{-1}\left[\frac{0.4 + \sin\alpha}{\cos\alpha}\right] \pm 10^{\circ}.$$

10. A golf putter head as set forth in claim 9 having a coefficient of restitution that results in an impulse force which creates over spin at a rate corresponding to pure rolling, and wherein such coefficient of restitution is determined through material selection and blade geometry.

11. A golf putter head as set forth in claim 9 wherein said plurality of blades is retained in a replaceable cartridge.

12. A method for manufacturing a golf putter head which comprises:

imparting a positive loft angle to the putting face diverging from vertical to the putter head base;

forming said putting face from a plurality of substantially parallel blades, each of said blades contiguous with each other and arraying said blades at a downward angle;

narrowing the width of each of said blades towards said putting face and terminating in a narrow tip;

crafting said blades with flexibly resilient tips such that the resilient tips of said parallel blades impart a spring force upon impact with a golf ball, and orienting said blades such that said spring force is an impulse force at angle θ, such that the impulse force creates over spin at a rate corresponding to pure rolling, and determining such an arrangement of the parallel blades through implementation of equation $$\Theta = \tan^{-1}\left[\frac{0.4 + \sin\alpha}{\cos\alpha}\right] \pm 10^{\circ}.$$

13. A method for manufacturing a golf putter head as set forth in claim 12 incorporating a coefficient of restitution that results in an impulse force which creates over spin at a rate corresponding to pure rolling, and determining such coefficient of restitution through material selection and blade geometry.

14. A method for manufacturing a golf putter head as set forth in claim 12 wherein said plurality of blade is retained in a replaceable cartridge.

* * * * *